US005501419A

United States Patent [19]

Huang

[11] Patent Number: 5,501,419

[45] Date of Patent: Mar. 26, 1996

[54] CHAIR LEG ASSEMBLY WITH THREE LEGS

[76] Inventor: Ching-Feng Huang, No. 42-4, Mintsu Rd., Hsinying City, Tainan Hsien, Taiwan

[21] Appl. No.: 354,821

[22] Filed: Dec. 8, 1994

[51] Int. Cl.[6] ..... A47B 91/00; F16M 11/20

[52] U.S. Cl. ..... 248/188.7; 248/188; 297/463.1; 297/440.1; 297/440.24; 297/344.1; 297/445.1; D6/498

[58] Field of Search ..... 297/463.1, 440.1, 297/440.24, 344.1, 445; 248/188, 188.7; D6/366, 498

[56] References Cited

U.S. PATENT DOCUMENTS

| | | | |
|---|---|---|---|
| 4,053,129 | 10/1977 | Graff | 248/188.7 |
| 4,318,570 | 3/1982 | Adam et al. | 248/188.7 X |
| 4,728,067 | 3/1988 | Steinmetzer et al. | 248/188.7 |
| 4,984,761 | 1/1991 | Chen | 248/188.7 |

FOREIGN PATENT DOCUMENTS

| | | | |
|---|---|---|---|
| 79681 | 12/1962 | France | 248/188.7 |
| 2524907 | 12/1976 | Germany | 248/188.7 |
| 2123687 | 2/1984 | United Kingdom | 248/188.7 |

*Primary Examiner*—Jose V. Chen
*Assistant Examiner*—Rodney B. White
*Attorney, Agent, or Firm*—Watson, Cole, Grindle & Watson

[57] ABSTRACT

A chair leg assembly includes a tubular sleeve member rotatably mounted around a lower end of a seat post of a chair, three extension legs each having a first end fixedly mounted to the tubular sleeve member, three support members each horizontally formed on a second end of a corresponding one of the extension legs, six pivot members each rotatably mounted on an underside of a corresponding one of distal ends of each of the support members, three pairs of wheels each pair rotatably mounted on an underside of a corresponding one of the pivot members.

5 Claims, 4 Drawing Sheets

CHAIR LEG ASSEMBLY WITH THREE LEGS

BACKGROUND OF THE INVENTION

1. Field of Invention

The present invention relates to a chair leg assembly, and more particularly to a chair leg assembly with three legs.

2. Related Prior Art

Conventional chair leg assemblies are shown in FIGS. 5 and 6. However, by such an arrangement, there are still some shortcomings in the conventional chair leg assemblies.

There will be a more complete and sufficient illustration in the detailed description of the preferred embodiments, concerning the conventional chair leg assemblies.

The present invention has arisen to mitigate and/or obviate the above-mentioned disadvantages of the conventional chair leg assemblies.

SUMMARY OF THE INVENTION

The primary objective of the present invention is to provide a chair leg assembly with three legs for cooperating with a seat post of a chair.

In accordance with one aspect of the present invention, there is provided a chair leg assembly comprising a tubular sleeve member rotatably mounted around a lower end of a seat post of a chair, three extension legs each having a first end fixedly mounted to the tubular sleeve member, three support members each horizontally formed on a second end of a corresponding one of the extension legs, six pivot members each rotatably mounted on an underside of a corresponding one of distal ends of each of the support members, six wheels each wheel rotatably mounted on an underside of a corresponding one of the pivot members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 5:
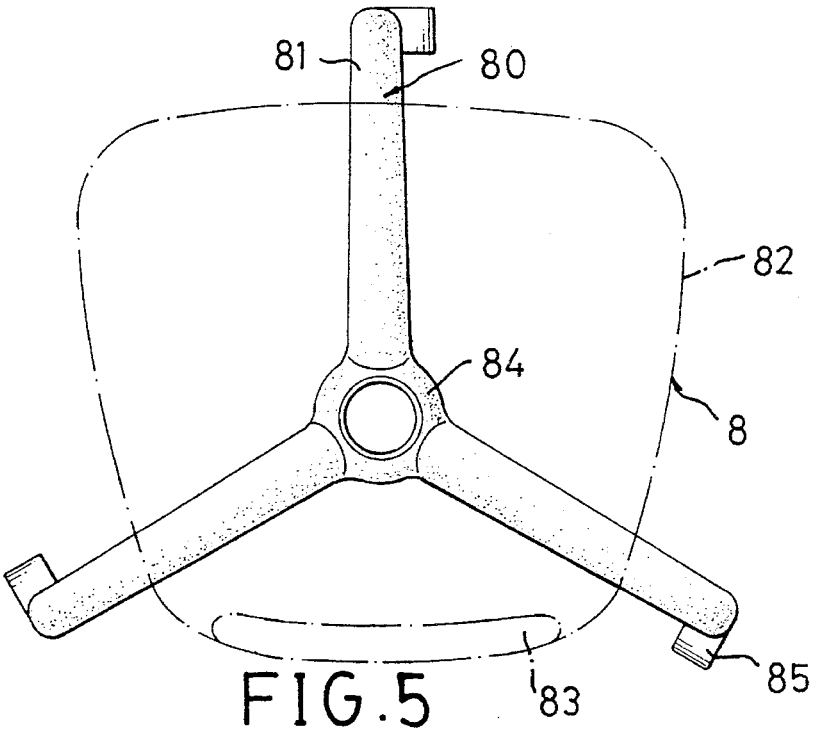
FIG.5 PRIOR ART
FIG. 5 is a top plan view of a first conventional chair leg assembly in accordance with the prior art.

Referring to FIG. 5, a first conventional chair leg assembly 80 in accordance with the prior art is provided for cooperating with a chair 8 which comprises a seat portion 82, a backrest 83 vertically formed on an upperside of the seat portion 82, a seat post (not shown) fixedly mounted on an underside of the seat portion 82, the chair leg assembly 80 comprising a tubular sleeve member 84 rotatably mounted around a lower end of the seat post, three legs 81 each having a first end attached to the sleeve member 84, and three wheels 85 each rotatably mounted on a second end of a corresponding one of the legs 81. By the above-mentioned installation, when the seat portion 82 together with the backrest 83 is rotated to a position as shown by phantom lines in FIG. 5, a user is apt to fall down when exerting a large force on the backrest 83 by his/her back due to a sliding movement of the wheels 85, so easily injuring the user.

Figure 6:
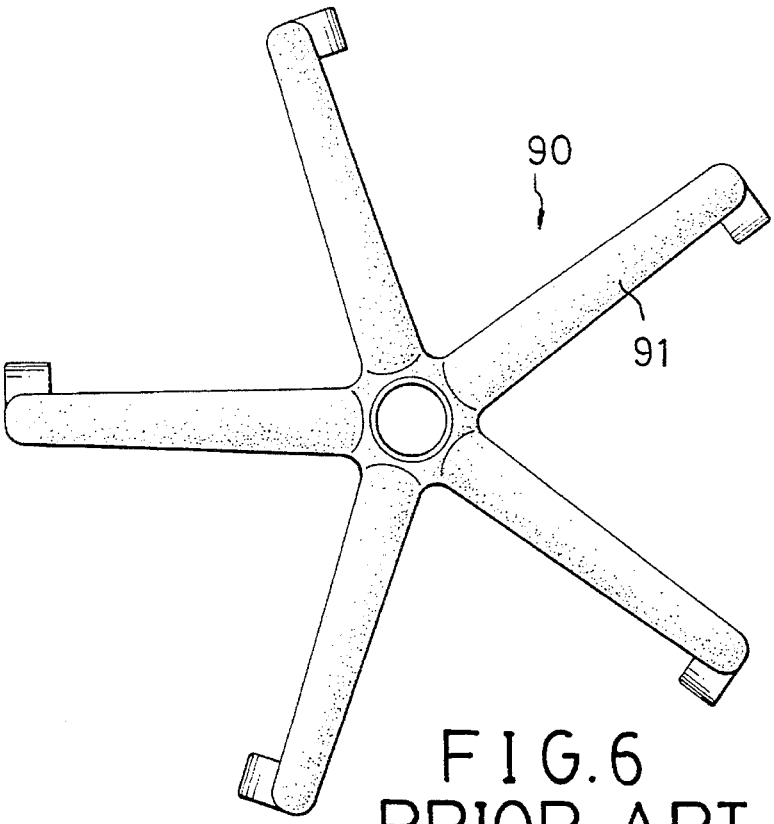
FIG.6 PRIOR ART
FIG. 6 is a top plan view of a second conventional chair leg assembly in accordance with the prior art.

Referring to FIG. 6, a second conventional chair leg assembly 90 in accordance with the prior art has a structure similar to that of the first conventional chair leg assembly 80 except that five legs 91 are provided instead of the three legs 81. By such an arrangement, the costs required for manufacturing the chair leg assembly with five legs are much higher than that required for fabricating a chair leg assembly with three legs, so greatly decreasing the competitive capability of the products. In addition, a user has a tendency to put his/her feet respectively on a corresponding one of the legs 91, thereby easily extending his/her legs too openly, so causing an inappropriate attitude and thereby not easily retaining himself/herself in a comfortable gesture during long-term sitting.

Figure 1:
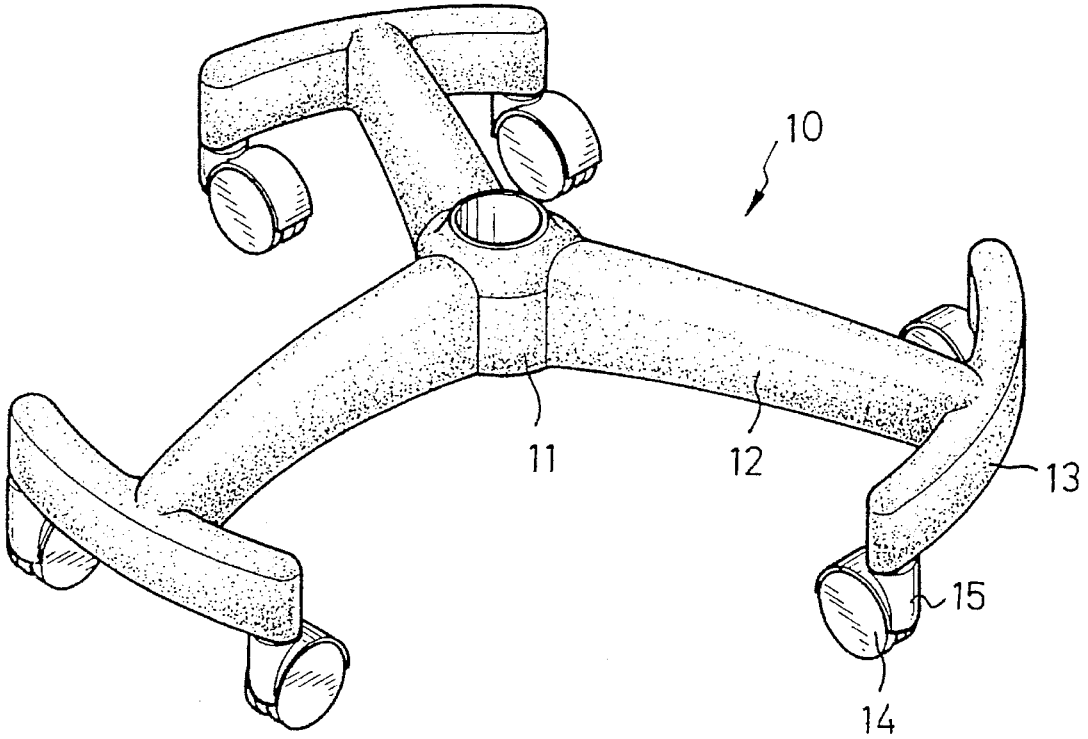
FIG. 1 is a perspective view of a chair leg assembly in accordance with the present invention.
Figure 2:
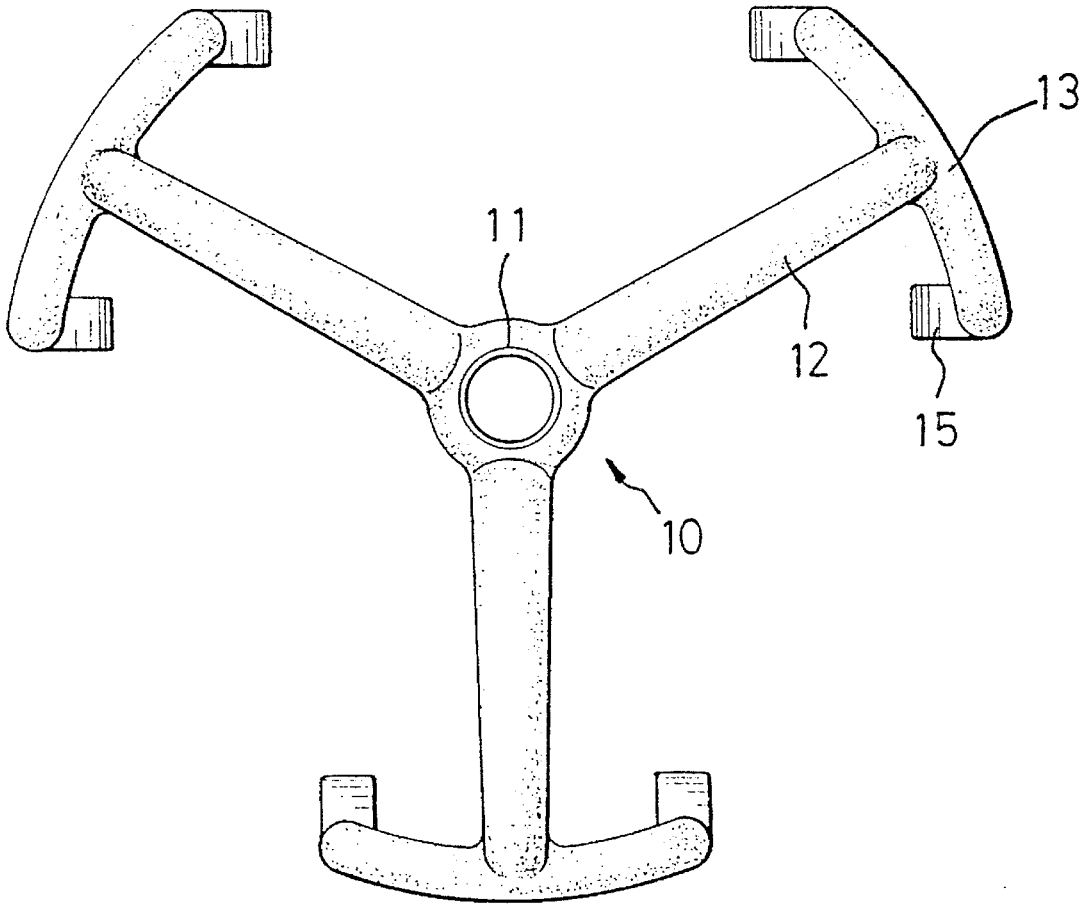
FIG. 2 is a top plan view of the chair leg assembly as shown in FIG. 1.
Figure 3:
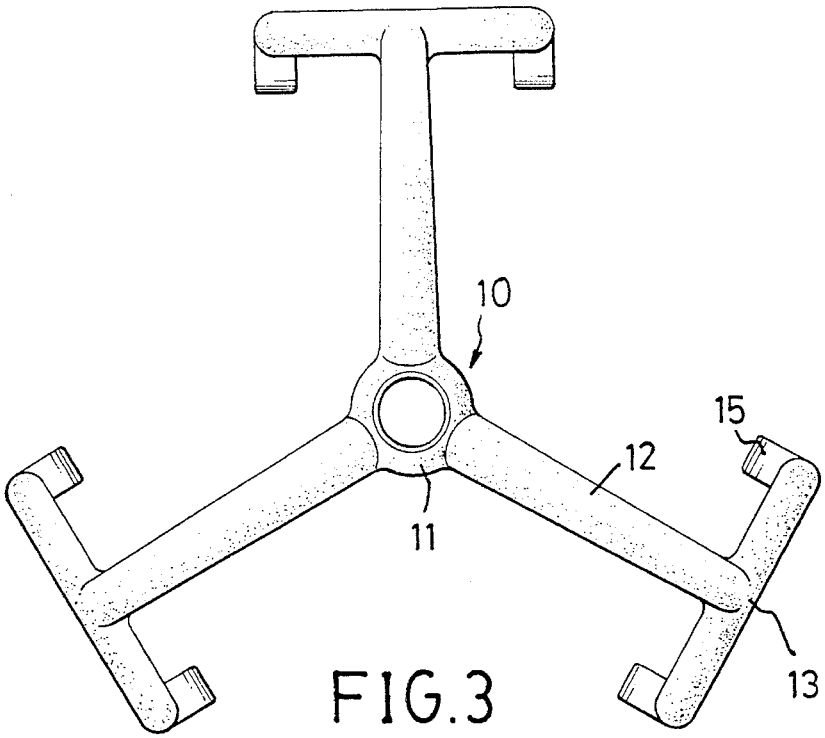
FIG. 3 is a top plan view of the chair leg assembly as shown in FIG. 1 with support members different from that as shown in FIG. 2.

Referring to FIGS. 1–4 and initially to FIGS. 1 and 2, a chair leg assembly 10 in accordance with the present invention is provided for cooperating with a chair (not shown) which comprises a seat portion (not shown) and a seat post (not shown) fixedly mounted on an underside of the seat portion, the chair leg assembly 10 comprising a tubular sleeve member 11 rotatably mounted around a lower end of the seat post of the chair, three extension legs 12 each having a first end fixedly mounted or integrally formed to the tubular sleeve member 11 and a second end, three horizontally support members 13 fixedly mounted on the second end of a corresponding one of the extension legs 12 and a tangent of each member 13 being perpendicular to the corresponding extension leg 12 and each of the support members having two distal ends associated with the second end of the extension leg 12 disposed at a mediate position therebetween, six pivot members 15 each rotatably mounted on an underside of a corresponding one of the distal ends of each of the support members 13, and three pairs of wheels 14 each pair rotatably mounted on an underside of a corresponding one of the pivot members 15. Preferably, each of the extension legs 12 is equi-distanced with each other. It is appreciated that each of the support members 13 has an arcuate shape as shown in FIG. 2 or is formed as a straight beam as shown in FIG. 3.

Figure 4:
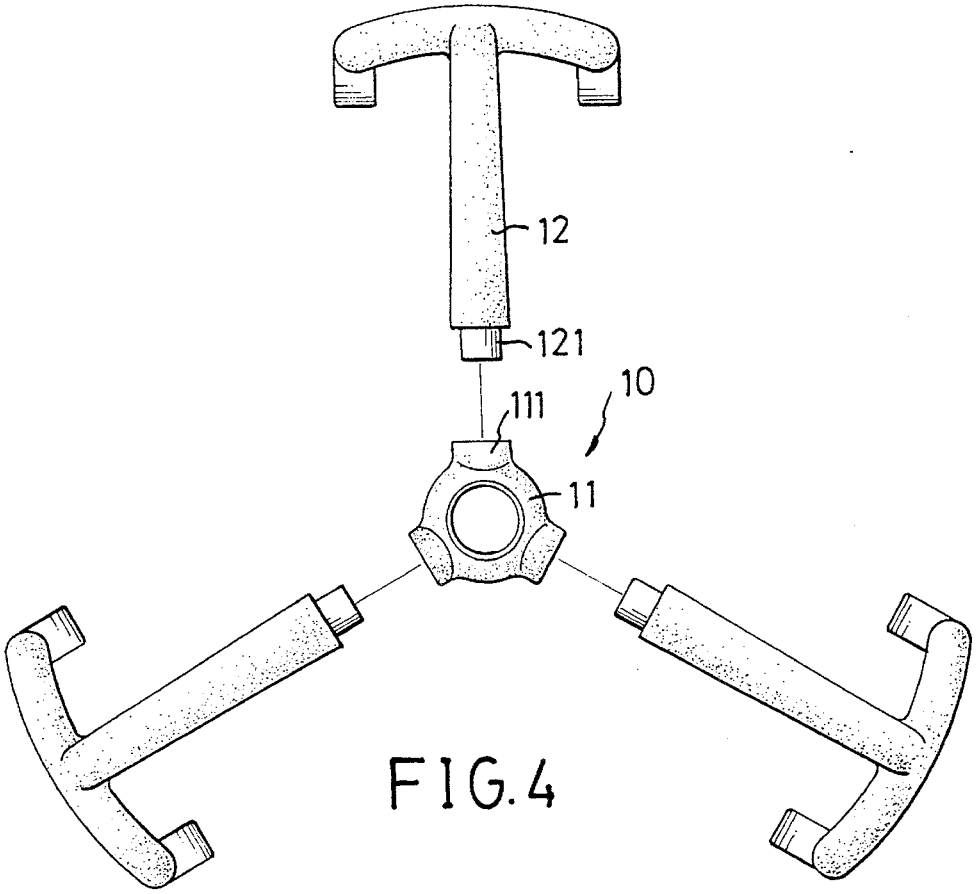
FIG. 4 is a top plan exploded view of the chair leg assembly.

Referring to FIG. 4, the tubular sleeve member 11 has three receiving sockets 111 horizontally defined therein, and three lug portions 121 are provided each extending outwardly from the first end of each of the extension legs 12 to be securely engaged in a corresponding one of the receiving sockets 111 by means of a bolt (not shown).

Accordingly, a chair leg assembly in accordance with the present invention has the following advantages and benefits:

(1) The three support members together with three pairs of wheels form a secure structure for stably supporting the chair.

(2) The costs required for manufacturing the chair leg assembly with three legs are much lower than those required for fabricating a chair leg assembly with five legs, thereby greatly increasing the competitive capability of the products.

(3) A user can put his/her feet respectively on a corresponding one of the two distal ends of the same support member, so avoiding extending his/her legs too openly, thereby retaining himself/herself in a more comfortable posture.

It should be clear to those skilled in the art that further embodiments of the present invention may be made without departing from the teachings of the present invention.

What is claimed is:

1. A chair leg assembly for cooperating with a chair which comprises a seat portion and a seat post fixedly mounted on an underside of said seat portion, said chair leg assembly comprising;

a tubular sleeve member rotatably mounted around a lower end of said seat post of said chair;

three extension legs each having a first end fixedly mounted to said tubular sleeve member and a second end;

three horizontally disposed support members each fixedly mounted on the second end of a corresponding one of said extension legs, each of said support members extending transversely to said respective extension legs, and each of said support members having two distal ends;

six pivot members each rotatably mounted on an underside of a corresponding one of said distal ends of each of said support members; and six wheels rotatably mounted on an underside of a corresponding one of said pivot members.

2. The chair leg assembly in accordance with claim 1, wherein each of said extension legs is equi-distanced relative to each other.

3. The chair leg assembly in accordance with claim 1 wherein said tubular sleeve member has three receiving sockets horizontally defined therein, three lug portions each extending outwardly from the first end of each of said extension legs securely engaged in a corresponding one of said receiving sockets.

4. A chair leg assembly in accordance with claim 1, wherein each of said support members is arcuate in shape.

5. A chair leg assembly in accordance with claim 1, wherein each of said support members is rectilinear.

* * * * *